US005522374A

United States Patent [19]

Clayton

[11] Patent Number: 5,522,374

[45] **Date of Patent: * Jun. 4, 1996**

[54] MULTI-SHOT AIR OPERATED, PROJECTILE LAUNCHER

[76] Inventor: Richard A. Clayton, 10200 Hillview Ave., Chatsworth, Calif. 91311

[ * ] Notice: The portion of the term of this patent subsequent to Feb. 16, 2010, has been disclaimed.

[21] Appl. No.: 15,137

[22] Filed: Feb. 9, 1993

Related U.S. Application Data

[63] Continuation-in-part of Ser. No. 793,186, Nov. 18, 1991, Pat. No. 5,186,156.

[51] Int. Cl.[6] ..... F41B 11/14; F41B 11/34

[52] U.S. Cl. ..... 124/59; 124/48; 124/66; 124/67

[58] Field of Search ..... 124/45, 48, 56, 124/59, 63–67

[56] References Cited

U.S. PATENT DOCUMENTS

| | | | |
|---|---|---|---|
| 399,882 | 3/1889 | Graydon | 124/59 |
| 1,259,463 | 3/1918 | De Fir . | |
| 1,478,597 | 12/1923 | Bebler | 124/59 |
| 2,237,678 | 4/1941 | Lohr et al. | 124/66 |
| 3,009,453 | 11/1961 | Ayala | 124/48 X |
| 3,111,121 | 11/1963 | Baggott | 124/67 |
| 3,205,883 | 9/1965 | Metcalf | 124/67 |
| 3,540,426 | 11/1970 | Lohr et al. . | |
| 3,818,887 | 6/1974 | Akiyama et al. | 124/67 |
| 3,913,553 | 10/1975 | Braughler | 124/44.7 X |
| 4,004,565 | 1/1977 | Fischer et al. | 124/45 |
| 4,004,566 | 1/1977 | Fischer | 124/59 |
| 4,289,109 | 9/1981 | D'Andrade | 124/67 |
| 4,411,249 | 10/1983 | Fogarty et al. | 124/64 |
| 4,422,433 | 12/1983 | Milliman | 124/44.7 X |
| 4,732,136 | 3/1988 | Ferri | 124/67 |
| 4,841,655 | 6/1989 | Ferri | 42/58 |
| 4,843,751 | 7/1989 | Ferri | 124/67 X |
| 4,848,307 | 7/1989 | Tsao | 124/59 |
| 4,986,251 | 1/1991 | Lilley | 124/67 |
| 5,186,156 | 2/1993 | Clayton | 124/59 |
| 5,224,464 | 6/1993 | Burnham et al. | 124/67 |

OTHER PUBLICATIONS

Kenner Nerf® "Missilestorm" toy.
"Mode Patrol Secret Agent," distributed by Edison Toys USA Inc.
"Bravo 17," manufactured for K–Mart Corporation.
"Nerf® Bow 'n' Arrow," distributed by Kenner Products Division.
Edison Toys USA Inc. Catalog.
Edison Toys USA Inc. Price List, Jan. 10, 1990.
Richard A. Clayton Deposition Transcript pp. 182–188, 202–204 and 214–215.

*Primary Examiner*—Eric K. Nicholson
*Assistant Examiner*—John A. Ricci
*Attorney, Agent, or Firm*—Blakely, Sokoloff Taylor, Zafman

[57] ABSTRACT

Air operated apparatus for successively launching a plurality of projectiles are disclosed. The apparatus employ novel constructions for multi-projectile magazines wherein projectiles may be launched from either the inner passageways of a plurality of barrels, or from the exteriors of the barrels. The magazines are designed for economical production as a molded unit. The apparatus are adapted so that an air pump may be cocked and the magazine advanced in a single operation through the use of a hand drawn slide mechanism. The invention further provides novel mechanisms for intermittent sealing of an air pump discharge port with successively selected projectile launching barrels on the magazine.

3 Claims, 3 Drawing Sheets

MULTI-SHOT AIR OPERATED, PROJECTILE LAUNCHER

This application is a Continuation-in-Part of Ser. No. 793,186, filed Nov. 18, 1991, Pat. No. 5,186,156.

BACKGROUND OF THE INVENTION

1. Field of the Invention

The present invention relates to air operated guns and projectile launchers, and more particularly to air operated devices capable of launching a plurality of projectiles without reloading.

2. Brief Description of the Prior Art

Single shot toy airguns have been in common use for many years in which a spring operated piston forces air from a chamber and through a barrel to eject a projectile from the barrel ( for example, Cagan et al., U.S. Pat. No. 4,212,285). Other toy airguns have been developed for launching multiple projectiles between loadings, such as Ferri (U.S. Pat. No. 4,841,655) and Tsao (U.S. Pat. No. 4,848,307). Difficulties and disadvantages are encountered with the aforementioned designs stemming from the methods of engagement of the airpump with the launching barrels for transfer of compressed air to the projectiles, and with constructions used for projectile magazines.

Tsao U.S. Pat. No. 4,848,307 provides a single airpump for propelling projectiles from a plurality of barrels in a rotating magazine, but provides no air seal between the airpump outlet 401 and barrels 21, and requires a special projectile having an internal air chamber 84 and funnel shaped tail 82 to catch an airstream from the airpump. This allows for significant amounts of air and hence propelling force to be lost in the gap between the airpump outlet 401 and the projectile 8.

Ferri U.S. Pat. No. 4,841,655 provides a constant spring bias 14 within a two piece projectile magazine 12A, 12C of expandable length whereby the magazine is always in tight engagement between the gun frame on its forward end and the airpump outlet 18A on its rearward end. This arrangement provides a seal between the magazine chambers 16 and the airpump outlet 18A but yields the undesirable side effect of high friction between the magazine and frame during advancement of the magazine, thus requiring sturdier construction and greater force for operation of the gun. The two effects oppose one another, whereby adjustment of the magazine bias to give a strong air seal generates a gun which is more difficult to operate while adjustment for ease of operation yields a gun with a poor airseal.

Projectile magazines for multi-shot air guns have in the past been typically formed as cylinders having a plurality of passageways in a symmetrical parallel spaced relationship about the cylinder's central axis as do both Ferri and Tsao. Such an arrangement can lead to much material being wasted in the structure of the cylinder and to warpage problems in molded parts if the spacing between passageways becomes relatively large, as will be the case for use with certain types of projectiles.

SUMMARY OF THE INVENTION

Accordingly, the above problems and difficulties are obviated by the present invention which provides novel means for sealing the air passage between an airpump and a magazine chamber or barrel whereby greater sealing force is applied between the airpump and the magazine during discharge of the airpump than during advancement of the magazine.

The present invention provides an airpump outlet or nozzle which is movable on the launch apparatus between a forward "firing" position and a rearward "cocking" position so that the airpump outlet may be engaged and sealed with a barrel of the projectile magazine during the time that air is discharged from the airpump, but may be drawn rearward away from the magazine during the time of magazine advancement to reduce friction or completely break engagement between the air outlet and the magazine. The present invention further provides means for normally biasing and clamping the magazine into a rearward position for closer engagement with the air outlet during discharge of air through the outlet and barrel, and means for overriding or disabling said biasing and clamping means during magazine advancement.

The present invention further provides novel magazine construction wherein individual tubular barrels are joined together by a support structure to eliminate wasted material between barrels, to allow greater design flexibility in spacing of the barrels, and to provide a simple and economical means of producing a multi-projectile magazine. The magazine may be formed in a wide variety of configurations—e.g., revolver, clip and ammo belt styles—and may be formed as a single piece by processes such as plastic injection and blow molding.

The present invention also provides novel designs for air operated guns and other air operated projectile launchers, and novel cocking and magazine advancing mechanisms for multi-shot air operated projectile launchers.

Therefore, it is among the primary objectives of the present invention to provide novel means for intermittently sealing the airpump of an air operated projectile launcher to a plurality of projectile launching tubes, chambers or barrels in a magazine.

It is further among the objectives of the present invention to provide a novel magazine construction for carrying a plurality of projectiles to be successively discharged from a projectile launcher.

It is another objective of the present invention to provide novel means for cocking and magazine advancement in multi-shot air operated projectile launchers.

It is a further objective of the present invention to provide several novel designs for air operated projectile launchers employing in various combinations the elements and features described above.

BRIEF DESCRIPTION OF THE DRAWINGS

The present invention, both as to its organization and manner of operation, together with further objects and advantages thereof, may best be understood with reference to the following description, taken in connection with the accompanying drawings in which.

DESCRIPTION OF EXEMPLARY EMBODIMENTS OF THE INVENTION

Figure 1:
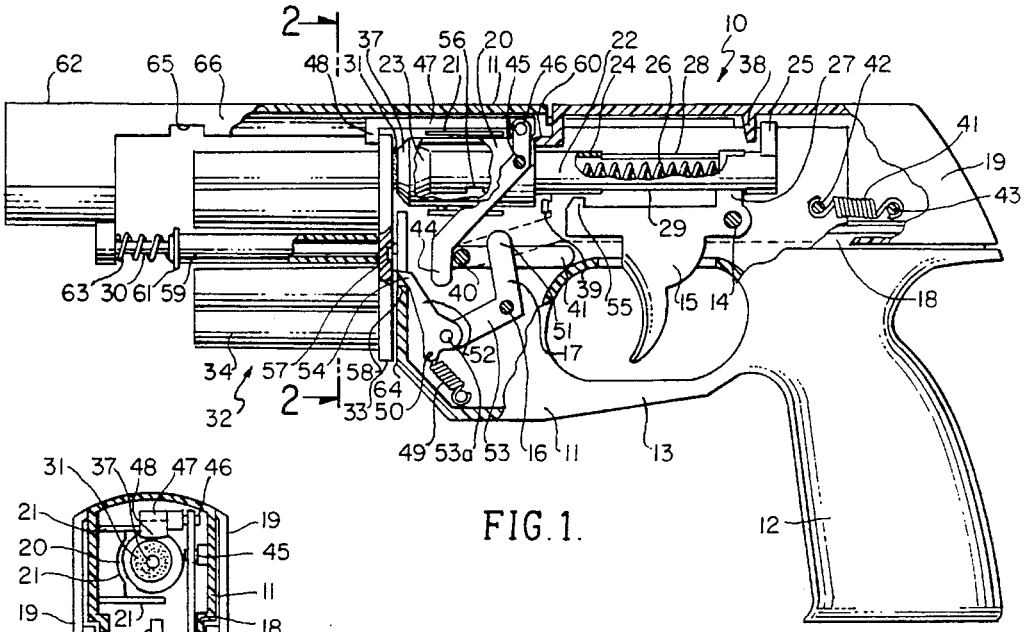
FIG. 1 is a side elevational view, partly in section, of a novel mechanical gun incorporating elements of the present invention.

Referring to FIG. 1, there is shown by way of illustration, but not of limitation, a mechanical pistol 10 designed and constructed in accordance with this invention. The pistol includes a frame 11, having a handle 12, trigger guard 13, a shaft 14 for pivotally mounting a trigger 15, a shaft 16 for pivotally mounting a magazine advancement arm 17, and guides 18 for carrying a slide assembly 19 for forward and rearward travel between a forward position and a rearward position. (The term "assembly" is used in this case to describe a device comprising a plurality of functional members, but it is to be understood that the device may actually be assembled from a plurality of parts or it may be molded or otherwise formed as a single piece. ) Carried within the frame 11 are a cylinder 20, and a plunger 22. The plunger comprises a piston 23, and a hollow shaft 24 having a protruding shoulder 25. Both the cylinder 20 and plunger 22 are movably carried for forward and reverse travel longitudinally within the frame 11. Interior members 21 of the frame 11 provide support for the cylinder 20. A spring 26 is carried within the plunger 22 such that one end of the spring rests at the forward end of the hollow shaft 24 and the other end of the spring 26 rests against an arm 27 of trigger 15 which protrudes into the interior of the hollow shaft 24 through a pair of slots 28, 29. In its uncocked state, as depicted in FIG. 1, the plunger 22 is in its most forward position so that the arm 27 is near the rearward end of the hollow shaft 24.

Figure 2:
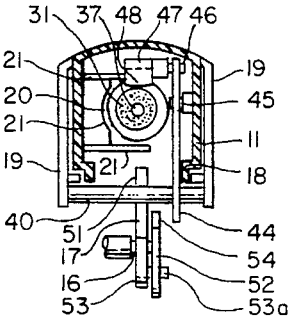
FIG. 2 is an end elevational view, partly in section, of the frame and magazine advancement and engagement mechanisms of the mechanical gun of FIG. 1.
Figure 7:
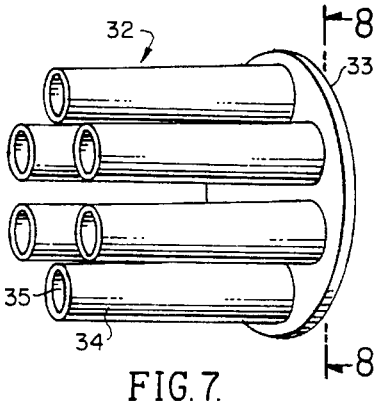
FIG. 7 is a perspective view of a cylindrically configured rotary style projectile magazine incorporating elements of the present invention.
Figure 8:
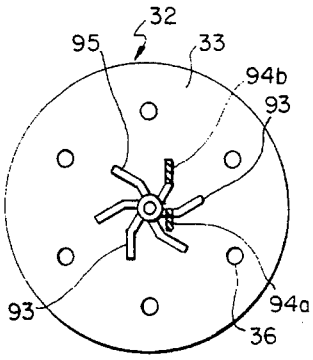
FIG. 8 is an end view of the magazine of FIG. 7 taken in the direction of arrows 8—8.

A projectile magazine 32 is rotatably carried by a shaft 30 on the frame 11 which supports a tubular bearing 59 on the magazine 32. In this embodiment of the invention, the magazine is able to slide forward and rearward on shaft 30, and is normally urged rearward by the bias of a spring 63. A washer 61 prevents the bearing 59 from dragging against the spring 63. The magazine 32 comprises a baseplate 33 to which a plurality of elongated barrels 34 are attached. A similar magazine is shown in greater detail in FIGS. 7 and 8. This and other magazine embodiments will be described in depth later in this specification. With reference to FIGS. 1, 7 and 8, each barrel 34 has a central passageway 35, open at both ends. The rearward opening 36 is of smaller diameter than the passageway 35 to provide a stop for a projectile to be inserted from the forward end, and for ease of alignment with a gasket 31 at the outlet 37 of cylinder 20 (refer also to FIG. 2). Each barrel is able to carry a projectile so as to form a generally airtight seal, as will be described in greater detail later in this specification.

In FIG. 1 the slide assembly 19 is shown in its forward, or rest, position, being biased to this position by the force of a spring 41 which is engaged between a shaft 42 on frame 11 and a shaft 43 at the rearward end of slide assembly 19. A shaft 40 at the forward end of slide assembly 19 protrudes to the interior of frame 11 through a pair of slots 41 to engage a lever 44 which is pivotally carried by a shaft 45 on the frame 11. The opposite end of the lever 44 is pivotally attached by a shaft 46 to a clamping arm 47. A protrusion 48 on the forward end of the clamping arm 47 engages baseplate 33 of the magazine 32 to draw the baseplate 33 rearward for sealing engagement with gasket 31 of the cylinder 20. It is noted that sealing force is derived from the bias of spring 41, which, in this embodiment of the invention, actuates the magazine clamping mechanism as previously described, and additionally forces a shoulder 60 on slide assembly 19 into engagement with cylinder 20 to drive the cylinder forward.

The pistol 10 is cocked and the magazine 32 is advanced as follows: An operator grips the handle 12 with one hand and draws the slide assembly 19 rearward with his/her other hand. A shoulder 38 on the interior surface of the slide 19 engages the shoulder 25 of the plunger 22 causing the plunger to travel rearward within frame 11, thereby compressing spring 26 against arm 27 of trigger 15. As the plunger 22 moves rearward, friction between the piston 23 and the interior surface of cylinder 20 drags cylinder 20 rearward such that the forward end of cylinder 20 is urged away from baseplate 33 of the magazine 32. A protruding member 39 on the frame 11 limits rearward movement of the cylinder 20 to a minimum whereby friction between the baseplate 33 and the gasket 31 is acceptably reduced without allowing lost motion to excessively shorten the effective stroke of the piston 23 within the cylinder. To further reduce friction between magazine 32 and cylinder gasket 31, as the slide assembly 19 moves rearward, shaft 40 is disengaged from lever 44, thereby removing clamping force from arm 47 and relaxing the hold of protrusion 48 on baseplate 33. Additionally, the shaft 40 on slide assembly 19 then engages the upper member 51 of the magazine advancement arm 17. As the slide 19 is drawn further rearward the shaft 40 pivots the arm 17 about shaft 16. A pawl 52, pivotally mounted by shaft 53*a* to the lower member 53 of arm 17, is raised upward whereby the tip 54 of pawl 52 engages a slot 57 in baseplate 33 to force the slot 57 upward, thereby rotating magazine 32 for successive alignment of barrels 34 with the air cylinder outlet 37. The pawl as shown in FIG. 1 normally rests against a point 58 on the frame 11 to prevent it from interfering with manual rotation of the magazine for loading. When the pawl 52 is raised upwardly by arm 17, a spring 49 exerts force on a member 50 of the pawl 52 to pivot the pawl 52 forwardly for engagement with baseplate 33. As the arm 17 pivots further, reactive force of the upper edge of slot 57 against tip 54 further urges the pawl 52 to pivot forwardly, thereby reinforcing engagement of the pawl 52 to the baseplate 33 and driving the magazine 32 forwardly on shaft 30, against force of spring 63, to further ensure acceptable disengagement between baseplate 33 and cylinder gasket 31. The forward movement of magazine 33 also prevents drag between the magazine and the forward bulkhead 64 of frame 11.

As the slide 19 reaches its most rearward position, the plunger 22 also reaches its most rearward position whereby a hook 55 on the trigger 15 becomes aligned with a hole 56 in the hollow shaft 24. Compression of the spring 26 against arm 27 pivots trigger 15 about shaft 14 such that the hook 55 engages the rim of the hole 56 to prevent the plunger 22 from moving in the forward direction when the slide 19 is returned forward. Spring 41, having been stretched by the rearward travel of the slide 19, serves to return the slide 19 forward upon release by the operator. As the slide 19 approaches its forwardmost position, spring 49 pulls pawl 52 downward and out of magazine engagement, spring 63 again urges magazine 32 rearwardly, shaft 40 again actuates the clamping mechanism of lever 44 and arm 47, and shoulder 60 on the slide again urges the cylinder 20 forward to form a generally airtight seal between the cylinder gasket 31 and magazine baseplate 33, and to form a continuous air channel comprising air cylinder outlet 37 and passageway 35 of the barrel 34 currently in firing alignment with gasket 31.

Figure 3:
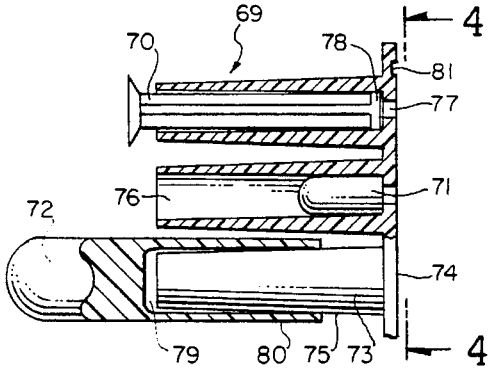
FIG. 3 is a side elevational view, partly in section, of a linearly configured clip style projectile magazine incorporating elements of the present invention.

Once cocked, the pistol 10 may be fired by pivoting the trigger 15 about shaft 14 to disengage hook 55 from hole 56 thus allowing the compressed spring 26 to expand, thrusting plunger 22 forward to force air out of cylinder 20 and through passageway 35 to discharge a projectile, such as 70, 71 or 72 in FIG. 3, from the barrel 34. Friction between plunger head 23 and the interior surface of cylinder 20 urges cylinder 20 forward, thus reinforcing the seal between cylinder 20 and barrel 34. After firing, the pistol 10 may once again be cocked and the magazine advanced as previously described.

A false barrel 62 is carried at the forward end of the frame 11 for cosmetic purposes. The inside diameter of the false barrel 62 is intended to be larger than the diameter of the projectiles used with the gun such that no contact is made between the projectile and the false barrel 62 at any time before, during or after projectile launch. Notches 65 are provided in the support 66 between the false barrel 62 and the frame 11 to allow clearance during magazine advancement for projectiles, similar to 71 of FIG. 3, which have enlarged suction cup type heads.

Figure 4:
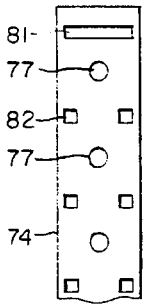
FIG. 4 is an end view of the magazine of FIG. 3 taken in the direction of arrows 4—4.

Referring to FIGS. 3 and 4, an embodiment of the projectile magazine of the present invention is shown. The magazine 69 comprises a plurality of individual tubular barrels 73 supported and joined together in a linear, side by side, parallel spaced configuration by an elongated baseplate 74. The baseplate 74 attaches to each barrel 73 generally orthogonally to the central longitudinal axis of the barrel. The use of individual tubes for the barrels 73, allows the barrels to be widely spaced with a minimum of material being required, since the areas between adjacent barrels 73 are for the most part devoid of material. Additionally, the use of individual tubes allows the magazine 69 to be used with hollow projectiles such as 72 which may be carried on the exterior surface 75 of a barrel 73. The magazine 69 is preferably formed, by a plastic molding or other suitable process, as a single piece comprising a plurality of barrels 73 and the supporting baseplate 74. The magazine as shown may be formed using a two piece mold which separates in the forward and rearward directions (left and right, respectively, in FIG. 3). A primary advantage of the single piece molded construction is the reduction of assembly requirements for the magazine 69.

The magazine 69 of FIGS. 3 and 4 is depicted in fragmentary form with three barrels 73 arranged in a linear parallel spaced configuration, stacked one on top of another, but it is understood that other than practical considerations such as size and structural integrity, there are no limits to the number of barrels 73 which may be so joined together.

A variety of projectile types, such as 70, 71 and 72, may be carried and launched by magazine 69. A common requirement for good launching distance is that the projectile be capable of blocking airflow through the barrel is central passageway 76 sufficiently for pressurized air delivered into the passageway 76 through a rearward opening 77 to eject the projectile from the barrel 73. This requirement is referred to herein as a "generally airtight seal". Projectile 70 achieves the aforementioned generally airtight seal with a circular piston 78 at its rearward end which is generally complementary to the cross-sectional shape and dimensions of the barrel's internal passageway 76. Projectile 71 is bullet shaped, having cross-sectional dimensions similarly matched to the internal passageway. Projectile 72 has a hollow interior 79 with the surrounding walls 80 being sized to slide snugly over the exterior surface 75 of a barrel 73. In the embodiment of FIG. 3, the inside diameter of each barrel 73 is reduced from front to rear in a tapered manner, and the outside diameter of each barrel 73 is reduced from rear to front in a tapered manner. This allows the greatest seal between a barrel 73 and an internally carried projectile 70, 71 or an externally carried projectile 72 to be achieved when the projectile is positioned rearwardly in or on the barrel 73. As the projectile is moved forwardly, the contact friction between barrel 73 and the projectile is reduced to allow compressed air delivered through opening 77 to freely accelerate and discharge the projectile from the barrel. It is understood that while the barrels 73 of FIG. 3 are shown to be tapered, a similar reduction of exterior and interior diameters may be achieved in a stepwise manner, or the barrels may be formed with uniform diameters over their length.

Figure 13:
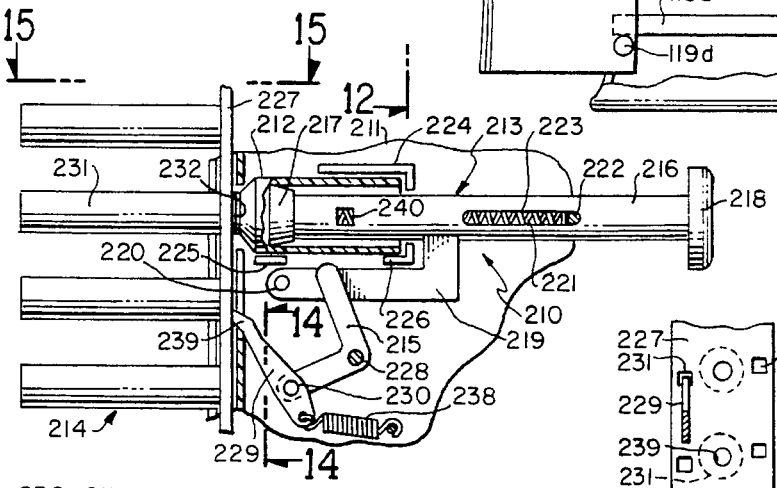
FIG. 13 is a fragmentary side view, partly in section, of a novel projectile launching apparatus employing elements of the present invention.

The magazine 69 is provided with recesses 81, 82 in baseplate 74, the edges of which function as ratchet surfaces for engagement with magazine advancing means on a cooperating projectile launching apparatus. An example of such an apparatus is shown in FIG. 13. The features and operation of this apparatus will be further described later herein. Note that the recesses 81, 82 are configured to be symmetrical about the central longitudinal axis of baseplate 74 so that either end of such a magazine may be initially inserted into a firing apparatus.

Figure 5:
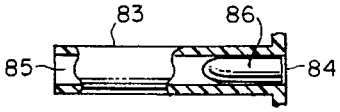
FIG. 5 is a side view, partly in section, of a projectile barrel configuration which may be employed in embodiments of the present invention.

The barrels 73 in FIG. 3 are shown with a rear opening 77 that is of smaller diameter than the passageway 76, so that a projectile 70, 71 inserted from the forward end of the barrel is prevented from protruding or exiting through the opening 77. In some embodiments of the invention, it will be desirable to load projectiles into a barrel from the rearward end. A barrel 83 adapted for rear loading is shown in FIG. 5. The barrel 83 comprises a rear opening 84 having generally the same diameter as the barrel's inner passageway 85, so that a projectile 86 having a similar cross-sectional diameter may be inserted through the opening 84.

Figure 6:
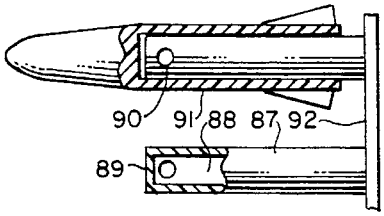
FIG. 6 is a side elevational view, partly in section of variation on the magazine of FIG. 3.

Another barrel configuration is shown in FIG. 6 in which the barrels 87 comprise a central passageway 88 which is sealed longitudinally at the forward end 89, with outlets 90 arranged for radial or side discharge. This configuration is designed for use only with externally carried projectiles, such as a hollow, rocket shaped projectile 91. The sealed end 89 of the longitudinal path through the passageway 88 adds a measure of safety against foreign objects being inserted or discharged. As in the previously described magazines, the barrels 87 are supported and joined together by a baseplate 92.

FIGS. 7 and 8 depict an embodiment 32 of the projectile magazine of the present invention in which the barrels 34 are supported and joined together by a baseplate 33 in a cylindrical parallel spaced relationship. The magazine is similar to that employed by the gun 10 of FIG. 1. As with the previously described linearly arranged magazine 69, the cylindrical magazine 32 is preferably molded or otherwise formed as a single piece comprising a plurality of barrels 34 and the baseplate 33. As with the linear magazine 69, the cylindrical magazine 32 may be formed using a two piece mold which separates in the forward and rearward directions. The passageways 35 within the barrels 34 open to the rear through openings 36 in the baseplate 33. The baseplate 33 is provided with indexing slots 93 for engagement with a magazine rotating advancement mechanism, such as the magazine advancing pawl 52 of FIG. 1. In FIG. 8, the tip of such a pawl is represented by numbers 94*a* and 94*b*. In the position of 94*a*, the pawl laterally engages a slot 93. As the pawl is moved upward toward the position of 94*b*, magazine 32 is forced to rotate to maintain engagement of the pawl and slot 93. When the pawl reaches the position of 94*b*, the pawl longitudinally engages the sides 95 of the slot 93. Assuming the pawl is constrained from sideways movement, the aforementioned longitudinal engagement will serve to index the magazine to facilitate alignment of an opening 36 with the air cylinder outlet of a cooperating launching apparatus, such as the gun 10 of FIG. 1.

Figure 10:
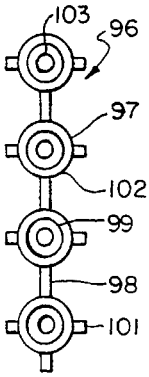
FIG. 10 is an end view of the magazine of FIG. 9 taken in the direction of arrows 10—10.
Figure 9:
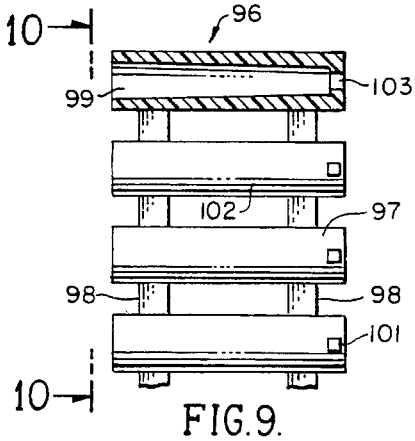
FIG. 9 is a side elevational view, partly in section, of a linearly configured belt style projectile magazine incorporating elements of the present invention.

FIGS. 9 and 10 depict another embodiment 96 of the projectile magazine of the present invention in which a plurality of barrels 97 are joined in a linear parallel configuration by support members 98 which attach to the barrels 97 and provide structural support generally parallel to the central longitudinal axes of the barrels 97. Such a configuration may be employed to simulate a belt type machine gun magazine. Preferably the magazine is molded or otherwise formed as a single piece from flexible plastic whereby the magazine is resiliently bendable between adjacent barrels 97, while the support members 98 maintain parallel alignment between adjacent barrels 97. As with the previously described magazine embodiments, each barrel 97 comprises a central passageway for carrying a projectile, such as 70 or 71 of FIG. 3, and a rearward opening 103 for receiving compressed air from the outlet of a cooperating air cylinder. Each barrel 97 is provided with protruding tabs 101 which may be engaged by magazine advancing and indexing means of a cooperating projectile launching apparatus. Additionally, the sides 102 of the barrels may be engaged by magazine advancing and indexing means, such as a sprocket or pawl.

Figure 11:
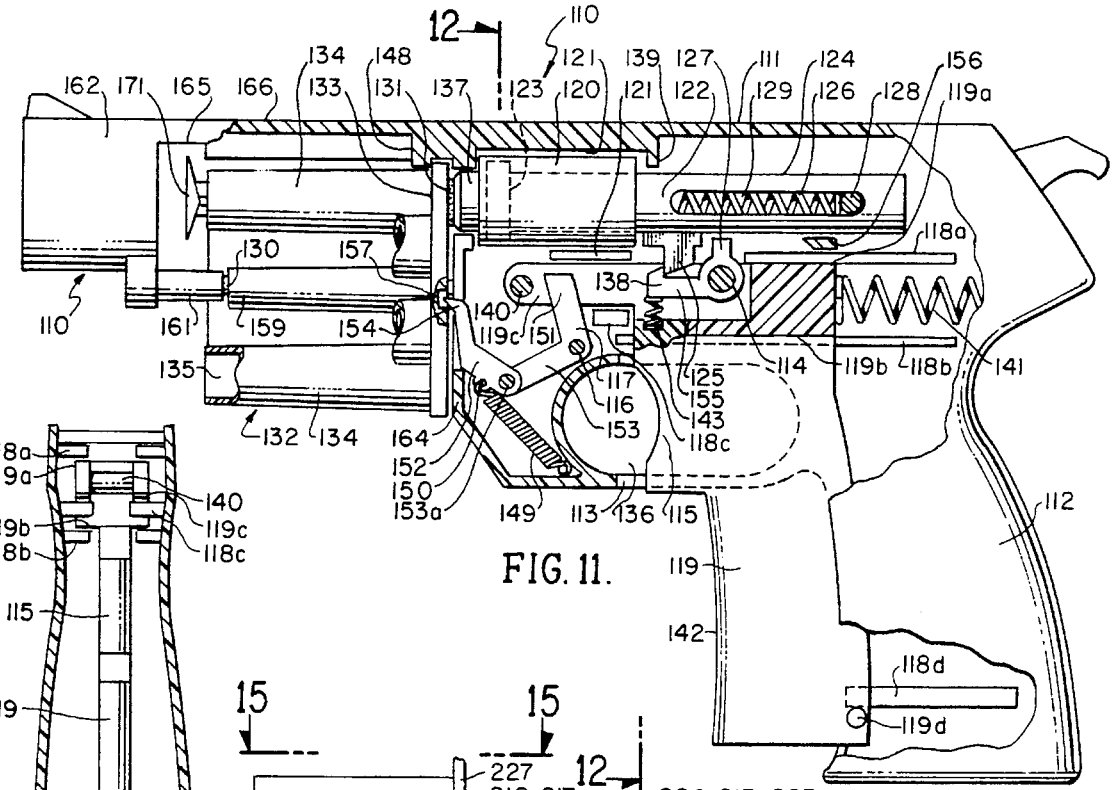
FIG. 11 is a side elevational view of a novel mechanical gun employing elements of the present invention to incorporate a slide cocking and magazine advancing mechanism into the gun's trigger.
Figure 12:
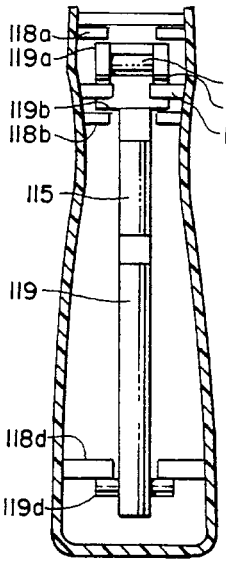
FIG. 12 is a fragmentary elevational view of the frame and slide element of the frame and slide element of the gun of FIG. 11, taken in the direction of arrows 12—12.

FIG. 11 shows an embodiment 110 of the present invention, which is a variation on the pistol 10 of FIG. 1. In the gun 110, the previously described slide mounted cocking and magazine advancement features are incorporated into a slide assembly 119 which simulates the trigger of a conventional gun. The gun 110 comprises a frame 111, having a handle 112, trigger guard 113, a shaft 116 for pivotally mounting a magazine advancement lever 117, and guides 118*a, b, c, d* for slidingly supporting a slide assembly 119, at surfaces 119*a, b, c, d*, for reciprocating travel between a forward rest position and a rearward cocked, or firing, position. Carried within the frame 111 are an air cylinder 120 and a plunger assembly 122 similar to corresponding elements previously described for FIG. 1. The cylinder 120 is supported by guides 121 for sliding movement between a forward position and a rearward position, with its travel limited by a shoulder 139 of frame 111. The plunger 122 is likewise supported for forward and rearward movement: at its rearward end by a shaft 128 which protrudes from the frame 111 through slots 129 in the hollow plunger shaft 124, and at its forward end by piston 123 which slides against the interior surface of cylinder 120. A spring 126 is carried within hollow shaft 124, with its forward end in contact with the forward end of hollow shaft 124 and its rearward end contacting shaft 128 which is fixed to the frame. The plunger 122 also comprises a protruding sear 125 for engagement with the hooked end 138 of a pawl 155 pivotally carried by slide assembly 119 about a shaft 114. A cylindrically configured projectile magazine 132, similar to that of FIGS. 7 and 8, is rotatably carried on frame 111 by a shaft 130 which supports a tubular bearing 159 of magazine 132. Note that in this embodiment, the forward movement of the magazine 132 is restricted by a portion 161 of shaft 130 having an enlarged diameter, and by a shoulder 148 protruding from the frame 111. The slidable, spring biased magazine configuration of FIG. 1 (ref spring 63) could also be implemented in this embodiment, but it has been omitted from this design for simplicity and reduction of parts. Note also that the clamping mechanism of FIG. 1 (ref lever 44 and arm 47) is not implemented in the embodiment of 110. The slide assembly in embodiment 110 is in its most rearward position when plunger 122 is released for a firing stroke, as will be explained in further detail, and thus is not available to actuate such a clamping device. Therefore, in the gun 110 of FIG. 11, intermittent engagement and disengagement of the air cylinder gasket 131 to the magazine baseplate 133 is facilitated by forward and rearward movement of cylinder 120 in response to forward and rearward movement of piston 123 within the cylinder 120.

The gun 110 of FIG. 11 is cocked and fired as follows: an operator inserts an index finger through an opening 136, in the frame 111 above the trigger guard 113, to grasp a member 115 of slide assembly 119 which simulates a conventional finger operated trigger. The operator's thumb is wrapped around the handle 112, and the remaining fingers of the hand are used to grasp the lower portion 142 of slide 119, which extends out from the frame 111 below trigger guard 113. The lower portion 142 of the slide may be omitted without deviating from the spirit of the present invention, however its inclusion provides for easier cocking and firing of the gun, particularly by a child who may have difficulty compressing spring 126 with the strength of a single finger. The operator, with hand positioned as described, now pulls the slide assembly 119 rearward on the frame 111. As the slide 119 moves rearward, hook 138 of pawl 155 engages sear 125 to draw plunger assembly 122 rearward, which in turn causes piston 123 to draw cylinder 120 rearward until the cylinder contacts shoulder 139, and causes spring 126 to be compressed between the forward end of hollow shaft 124 and shaft 128 of the frame. The slide 119 also compresses a slide return spring 141 against frame 111. The slide further comprises a shaft 140 which engages and pivots magazine advancement lever 117. The tip 154 of pawl 152 engages slot 157 in the magazine baseplate 133 to rotate magazine 132 in the manner previously described for the devices of FIGS. 1, 7 and 8. As slide assembly 119 reaches its cocked, or firing position, a release lever 127 on pawl 155 engages a member 156 of the frame 111 to pivot pawl 155 about shaft 114 and withdraw hook 138 from engagement with sear 125. Note that the forward surface of the frame release member 156 is sloped such that it will engage the uppermost corner of pawl release lever 127, to provide maximum releasing leverage to the pawl 155.

With pawl 155 withdrawn, the spring 126, compressed within plunger assembly 122, abruptly urges the plunger 122 forward. Friction between piston 123 and cylinder 120 forces the cylinder forward to seal gasket 131 to the magazine baseplate 133. All further forward motion of the plunger 122 drives piston 123 forward within cylinder 120 to force pressurized air from the cylinder outlet end 137 and into the inner passageway 135 of the barrel 134 currently in firing alignment with the cylinder 120, thereby ejecting the projectile 171 from the barrel. The projectile exits the gun 110 through a false barrel 162 similar to that of FIG. 1.

After the projectile 171 is discharged, the operator releases the trigger 115, 142, allowing spring 141 to return the slide assembly 119 to its forward rest position. The sloping forward surface of hook 138 slides over the sloping rearward surface of sear 125, forcing pawl 155 to pivot downward. Once hook 138 is past the sear 125, a spring 143 carried on the slide assembly 119 urges pawl 155 upward to place hook 138 in its rest position in front of sear 125.

Figure 14:
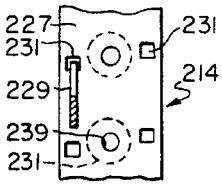
FIG. 14 is a fragmentary end view of the magazine and magazine advancing pawl of FIG. 13, taken in the direction of arrows 14—14.
Figure 15:
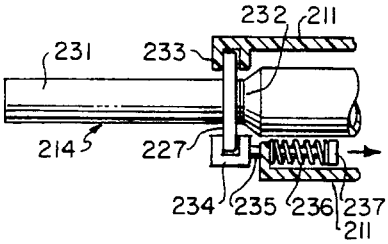
FIG. 15 is a fragmentary view of the apparatus of FIG. 13, taken in the direction of arrows 15—15.

Referring to FIGS. 13, 14 and 15, a variation on the previously described embodiments is shown in which the slide mounted cocking and magazine advancing features are incorporated into a plunger assembly. In this embodiment, a projectile launching apparatus 210 comprises a frame 211 upon which are carried an air cylinder 212, a plunger-like slide assembly 213, a projectile magazine 214, and a magazine advancement lever 215. The cylinder 212 is loosely carried on the frame 211, and may be moved forwardly and rearwardly along guides 224, 225 and 226, with rearward travel being limited by rear protrusions on guides 224 and 226, and forward travel being limited by the baseplate 227 of magazine 214. The slide assembly 213 comprises a hollow shaft 216, a piston 217 at the forward end of shaft 216, a flange 218 at the rearward end of shaft 216, and forwardly extended arm 219 having a protruding shaft 220 on its forward end. A spring 221 is carried within the hollow shaft 216 with its forward end resting against the inside of the forward end of shaft 216 and its rearward end resting against a shaft 222 which protrudes from the frame 211 into the hollow shaft 216 through slots 223.

An operator of the invention may cock the apparatus 210 by using a hand or other suitable means to keep the frame stationary with respect to the slide assembly 213 while using another hand or other suitable means to grasp or engage the flange 218 to draw the slide assembly 213 rearward. As the slide assembly 213 moves rearwardly the piston 217 drags the cylinder 212 rearward into the protrusions of guides 224 and 226. As the slide 213 moves further rearward, shaft 220 on arm 219 engages lever 215 to pivot the lever about its mounting shaft 228. Lever 215 raises a pawl 229, pivotally carried on lever 215 by a shaft 230, so that the pawl 229 engages a recess 231 on the magazine baseplate 227 and drives the magazine 214 through a calibrated range of motion to move one barrel 231 out of alignment with the outlet or nozzle end 232 of the cylinder 212 and to move an adjacent barrel 231 into alignment. The magazine is carried by guides 233 on the frame 211 and a movable guide 234. The movable guide 234 is carried by a shaft 235 which extends inside frame 211. A spring 236 on the shaft is compressed between the frame 211 and a flange 237 on the shaft 235, whereby the movable guide 234 is normally urged toward the frame to draw the magazine rearward for engagement with the air cylinder outlet 232. The magazine advancing pawl 229 normally extends from its pivotal mounting shaft 230 both in the direction of magazine advancing motion and in the direction of the magazine 214. Thus as the pawl 229 urges magazine 214 upward, as oriented in FIG. 13, leverage of the magazine 214 on pawl 229 will tend to rotate the pawl counterclockwise, urging the tip 239 of the pawl and the magazine 214 further forward against the bias of spring 236 on movable guide 234. With the magazine 214 pushed forward as described, the friction between baseplate 227 and nozzle 232 is reduced for the duration of magazine advancing motion.

Once cocked as described above, the apparatus 210 is fired simply by releasing the flange 218 to allow spring 221 to drive the piston 217 away from shaft 222 and forward within the cylinder 212. The cylinder 212 is pushed forward by friction of the piston 217, and at the same time, shaft 220 is moved forward to allow a spring 238 to retract pawl 229, which in turn allows spring 236 to pull the magazine baseplate 227 rearward, whereby the baseplate 227 and cylinder nozzle 232 are forced into mutual engagement. The piston 217 continues forward within the cylinder 212 to force air from the cylinder 212 through nozzle 232 and into the aligned barrel 231 through a rear opening 239 in the baseplate 227, for discharge of a projectile as has been previously described. When configured for firing as described above the apparatus 210 may be used in the construction of "pull-and-release" type devices such as a multi-shot air operated toy bow and arrow.

A releasable latch may optionally be added to the apparatus of FIG. 13 for engagement with an opening in the hollow shaft 216, to retain the slide assembly 213 in its rearward cocked position. Such a latch may be similar in form and function to the trigger 15 and hook 55 of FIG. 1. In this case, with the slide assembly 213 drawn rearward, the opening 240 would become aligned with hook 55, whereby hook 55, biased by suitable means would be urged to enter the opening 240 to prevent forward travel of the slide 213. The apparatus would be fired by pulling on trigger 15 to withdraw hook 55 from the opening 240. When configured for firing as described above the apparatus 210 may be used in the construction of triggered devices such as a multi-shot, air operated toy crossbow, armored vehicle, or firearm.

A separate cocking device may be optionally added to actuate the slide assembly 213. Such a cocking device may be similar in form and function to the slide assembly 19 of FIG. 1. In this case, the shoulder 38 of slide 19 would engage the forward side of flange 218 whereby rearward movement of the slide 19 would cause shoulder 38 to drag slide assembly 213 rearward as well.

Figure 16:
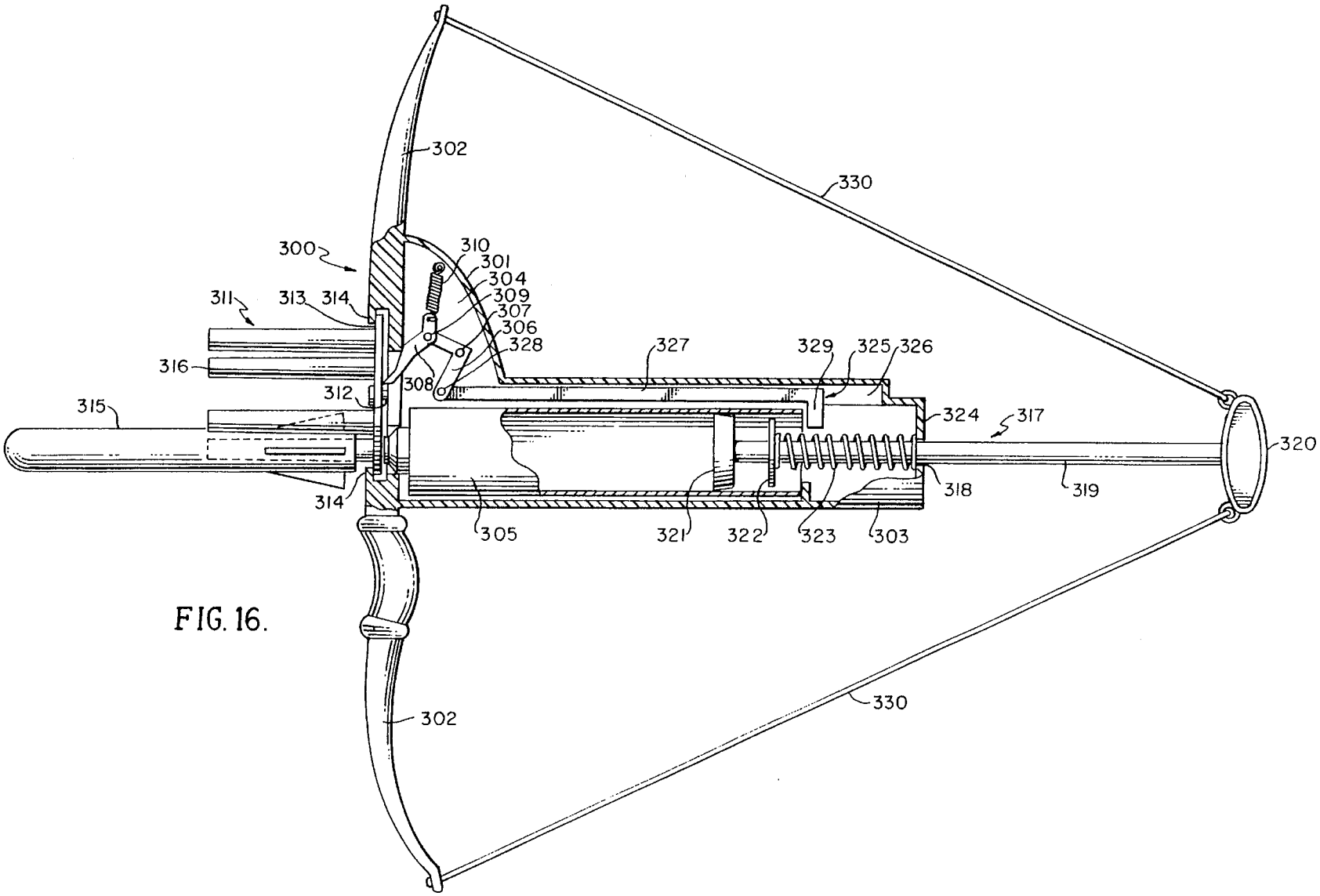
FIG. 16 is a side elevational view, partly in section, of a novel bow and arrow type apparatus employing elements of the present invention.

With reference to FIG. 16, elements of the present invention are employed in the construction of a toy bow and arrow apparatus 300 which comprises a frame 301 having bow members 302, an airpump housing 303, and an advancement mechanism housing 304. Within the airpump housing 303, an elongated air cylinder 305 which is movably carried for limited forward and rearward travel as has been described for previously discussed embodiments of the invention. Within the advancement mechanism housing 304, lever 306 is pivotally carried about a shaft 307 on the frame 301. A pawl 308 is pivotally carried about a shaft 309 on the lever 306. The pawl 308 and lever 306 are biased to rest positions, as depicted, by a spring 310. A cylindrically configured projectile magazine 311, similar to that of FIGS. 7 and 8, is rotatably mounted to the frame 301 about a shaft 312. The magazine baseplate 313 is additionally supported and guided by shoulders 314 on the bow members 302. The magazine is adapted to carry elongated toy arrows 315 on the exterior surfaces of the barrels.

A plunger assembly 317 is slidably carried by an opening 318 at the rear end 324 of the airpump housing 303. The plunger assembly 317 comprises a shaft 319, a handle 320 at the rear end of the shaft 319, a piston 321 at the front end of the shaft, a flange 322 on a forward portion of the shaft, and a spring 323 carried about the shaft 319 for compression between the flange 322 and the rear end 324 of the airpump housing 303. A secondary slide assembly 325 is operably carried within a side chamber 326 of the airpump housing 303. The slide assembly 325 comprises an elongated member 327 which is pivotally joined to lever 306 by a shaft 328, and a shoulder 329 which extends into the rearward path of flange 322 of the plunger, or primary slide assembly, 317. The plunger assembly 317 is depicted in an intermediately rearward position. If the plunger 317 is drawn fully rearward, flange 322 engages shoulder 329 and pulls the secondary slide assembly 325 rearward, which in turn pivots lever 306 to induce magazine advancement as has been described for previously discussed embodiments.

In FIG. 16 an arrow 315 is depicted on the barrel 316 currently in firing position. If the plunger assembly 317 is driven forward by spring 323, or any other means, piston 321 will urge cylinder 305 forward for sealing engagement with the magazine 311 and force air from within the cylinder 305 and through the aligned barrel 316 to launch the projectile or arrow 315. If however the plunger assembly 317 is drawn from the depicted position to its fully rearward position, flange 322 will actuate the magazine advancement mechanism of 327, 306 and 308, causing the depicted projectile 315 to be rotated out of firing alignment. Thus, once the apparatus 300 has been cocked by the rearward positioning of plunger assembly 317, the magazine 311 may be advanced repeatedly to move any desired barrel 316 into or out of firing alignment by cyclical movement of the plunger 317 over a short range of travel near its fully rearward position.

Note that firing force may be applied to drive the plunger 317 forward by many different means, either individually or in combination. Such means may include but are not limited to: the bias of a spring such as spring 323, resilient stretching of bowstrings 330 connected from the bow members 302 to the plunger assembly 317, resilient bending of the bow members 302, and pushing force applied by an operator to an accessible portion of plunger assembly 317, such as handle 320.

While particular embodiments of the present invention have been shown and described, it will be obvious to those skilled in the art that changes and modifications may be made without departing from this invention in its broader aspects and therefore the aim in the appended claims is to cover all such modifications as fall within the true spirit and scope of this invention.

What is claimed is:

1. An air operated projectile launcher comprising:

a frame:

an air chamber:

a plunger movably carried for travel from a cocked position to a discharged position for compression of air within said chamber:

hand drawn slide means operably carried for moving said plunger from said discharged position to said cocked position, wherein said slide means is intermittently engageable with said plunger for drawing said plunger from said discharged position to said cocked position;

outlet means cooperating with said chamber for discharge of air compressed by said plunger:

a plurality of projectile launching barrels affixed to a supporting structure:

said barrels being selectively alignable with said outlet means to receive air discharged from said chamber to expel a projectile carried by a selected barrel:

advancement means for successive alignment of said barrels with said outlet means:

wherein said air chamber is movable with respect to said frame for intermittent sealine engagement of said outlet means with a selected barrel of said magazine:

means for propelling said plunger from said cocked position to said discharged position to discharge air under pressure from said chamber: said plunger cooperating with said advancement means such that operative travel of said plunger actuates said advancement means.

2. An air operated projectile launcher comprising:

a frame:

an air chamber:

a plunger movably carried for travel from a cocked position to a discharged position for compression of air within said chamber:

latch means for retaining said plunger in said cocked position;

trigger means for releasing said plunger from said latch;

hand drawn slide means operably carried for moving said plunger from said discharged position to said cocked position:

outlet means cooperating with said chamber for discharge of air compressed by said plunger:

a plurality of projectile launching barrels affixed to a supporting structure:

said barrels being selectively alignable with said outlet means to receive air discharged from said chamber to expel a projectile carried by a selected barrel:

advancement means for successive alignment of said barrels with said outlet means:

wherein said air chamber is movable with respect to said frame for intermittent sealing engagement of said outlet means with a selected barrel of said magazine:

means for propelling said plunger from said cocked position to said discharged position to discharge air under pressure from said chamber: said plunger cooperating with said advancement means such that operative travel of said plunger actuates said advancement means.

3. An air operated projectile launcher comprising:

a frame;

an air chamber;

a plunger movably carried for travel from a cocked position to a discharged position for compression of air within said chamber;

hand drawn slide means operably carried for moving said plunger from said discharged position to said cocked position;

outlet means cooperating with said chamber for discharge of air compressed by said plunger;

a plurality of projectile launching barrels affixed to a supporting structure;

said barrels being selectively alignable with said outlet means to receive air discharged from said chamber to expel a projectile carried by a selected barrel;

advancement means for successive alignment of said barrels with said outlet means;

means for propelling said plunger from said cocked position to said discharged position to discharge air under pressure from said chamber;

said plunger cooperating with said advancement means such that operative travel of said plunger actuates said advancement means;

said plunger comprising a protruding appendage for engagement with and actuation of said advancement means;

said appendage comprising a first member joined to said plunger rearwardly of said air chamber with said plunger in said discharged position;

said appendage further comprising a second member extending from said first member forwardly toward said magazine;

said first member serving to space said second member from said air chamber to allow travel of said second member generally parallel to a side of said chamber;

said second member serving as a drive link for imparting motion to said advancement means.

* * * * *

UNITED STATES PATENT AND TRADEMARK OFFICE

CERTIFICATE OF CORRECTION

PATENT NO. : 5,522,374

DATED : June 4, 1996

INVENTOR(S) : Richard A. Clayton

It is certified that errors appear in the above-identified patent and that said Letters Patent is hereby corrected as shown below:

On the title page, item

In [54] Title, please delete " OPERATED, " and insert -- OPERATED --.

In column 1 at line 1, please delete " OPERATED, " and insert -- OPERATED --.

In column 1 at line 28, please delete " U.S. Pat. No. 4,848,307 " and insert -- ( U.S. Pat. No. 4,848,307) --

In column 1 at line 37, please delete " U.S. Pat. No. 4,841,655 " and insert -- ( U.S. Pat. No. 4,841,655) --

In column 6 at line 19, please delete " barrel is " and insert -- barrel's --

In column 10 at line 63, please delete " lever " and insert -- a lever --.

Signed and Sealed this

Tenth Day of September, 1996

*Attest:*

Bruce Lehman

BRUCE LEHMAN

*Attesting Officer*

*Commissioner of Patents and Trademarks*